US011911654B1

(12) United States Patent
Plummer

(10) Patent No.: US 11,911,654 B1
(45) Date of Patent: Feb. 27, 2024

(54) FOOT-ATTACHED EXERCISE ROLLERS

(71) Applicant: Shawn Plummer, West Orange, NJ (US)

(72) Inventor: Shawn Plummer, West Orange, NJ (US)

( * ) Notice: Subject to any disclaimer, the term of this patent is extended or adjusted under 35 U.S.C. 154(b) by 140 days.

(21) Appl. No.: 17/694,793

(22) Filed: Mar. 15, 2022

(51) Int. Cl.

| | |
|---|---|
| ***A63B 22/20*** | (2006.01) |
| ***A63B 21/00*** | (2006.01) |
| ***A43B 5/18*** | (2006.01) |
| ***A63C 17/04*** | (2006.01) |
| ***A63C 17/00*** | (2006.01) |

(52) U.S. Cl.
CPC ..... *A63B 22/20* (2013.01); *A43B 5/18* (2013.01); *A63B 21/4015* (2015.10); *A63C 17/04* (2013.01); *A63C 2017/0053* (2013.01)

(58) Field of Classification Search
CPC . A63B 22/20; A63B 21/4015; A63B 21/4011; A63B 21/068; A43B 5/18; A63C 17/04; A63C 2017/0053; A63C 17/1436; A63C 17/14; A63C 17/262; A61H 2201/165
See application file for complete search history.

(56) References Cited

U.S. PATENT DOCUMENTS

| | | | | |
|---|---|---|---|---|
| 2,069,384 A | | 2/1937 | Ogden | |
| 3,784,192 A | | 1/1974 | Nutter | |
| 4,061,348 A | * | 12/1977 | Carter | A63C 17/02 280/11.201 |
| 6,328,680 B1 | | 12/2001 | Shifferaw | |
| 6,942,605 B1 | | 9/2005 | Sukhovitsky | |
| 7,621,858 B2 | | 11/2009 | Sheron | |
| D654,545 S | | 2/2012 | Elrid | |
| 8,382,645 B2 | | 2/2013 | Mylrea | |
| 2008/0016722 A1 | * | 1/2008 | Battaglino | A63B 22/16 36/114 |
| 2008/0034617 A1 | * | 2/2008 | Anderson | A63C 17/04 36/116 |

FOREIGN PATENT DOCUMENTS

| | | | |
|---|---|---|---|
| CA | 2976560 A1 | * | 2/2019 |
| KR | 102321517 B1 | * | 11/2021 |

* cited by examiner

*Primary Examiner* — Sundhara M Ganesan
*Assistant Examiner* — Jacqueline N L Loberiza
(74) *Attorney, Agent, or Firm* — Kyle A. Fletcher, Esq.

(57) ABSTRACT

The foot-attached exercise rollers comprises a toe cover, a strap, a plurality of rollers, and a plurality of grips. The foot-attached exercise rollers may be an exercise device that may be adapted to be worn on the foot. The toe cover may cover the front of a foot held in place by the strap. The plurality of rollers may be adapted to reduce friction between the front of the toe cover and a floor and the plurality of grips may be adapted to increase friction between the rear of the toe cover and the floor. The foot-attached exercise rollers may be adapted to be worn in pairs to exercise the user's core as a user moves the feet back and forth on the plurality of rollers while attempting to keeping the upper body still.

17 Claims, 6 Drawing Sheets

FOOT-ATTACHED EXERCISE ROLLERS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise equipment, more specifically, a foot-attached exercise rollers.

Summary of Invention The foot-attached exercise rollers comprises a toe cover, a strap, a plurality of rollers, and a plurality of grips. The foot-attached exercise rollers may be an exercise device that may be adapted to be worn on the foot. The toe cover may cover the front of a foot held in place by the strap. The plurality of rollers may be adapted to reduce friction between the front of the toe cover and a floor and the plurality of grips may be adapted to increase friction between the rear of the toe cover and the floor. The foot-attached exercise rollers may be adapted to be worn in pairs to exercise the user's core as a user moves the feet back and forth on the plurality of rollers while attempting to keeping the upper body still.

An object of the invention is to provide an exercise device that attaches to a foot.

Another object of the invention is to provide a toe cover that covers the front of a foot and is retained by a strap around the ankle.

A further object of the invention is to a plurality of rollers at the front of the sole to reduce friction between the sole of the toe cover and the floor.

Yet another object of the invention is to provide a plurality of grips rearward of the rollers to increase friction between the sole and the floor.

These together with additional objects, features and advantages of the foot-attached exercise rollers will be readily apparent to those of ordinary skill in the art upon reading the following detailed description of the presently preferred, but nonetheless illustrative, embodiments when taken in conjunction with the accompanying drawings.

In this respect, before explaining the current embodiments of the foot-attached exercise rollers in detail, it is to be understood that the foot-attached exercise rollers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the foot-attached exercise rollers.

It is therefore important that the claims be regarded as including such equivalent construction insofar as they do not depart from the spirit and scope of the foot-attached exercise rollers. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
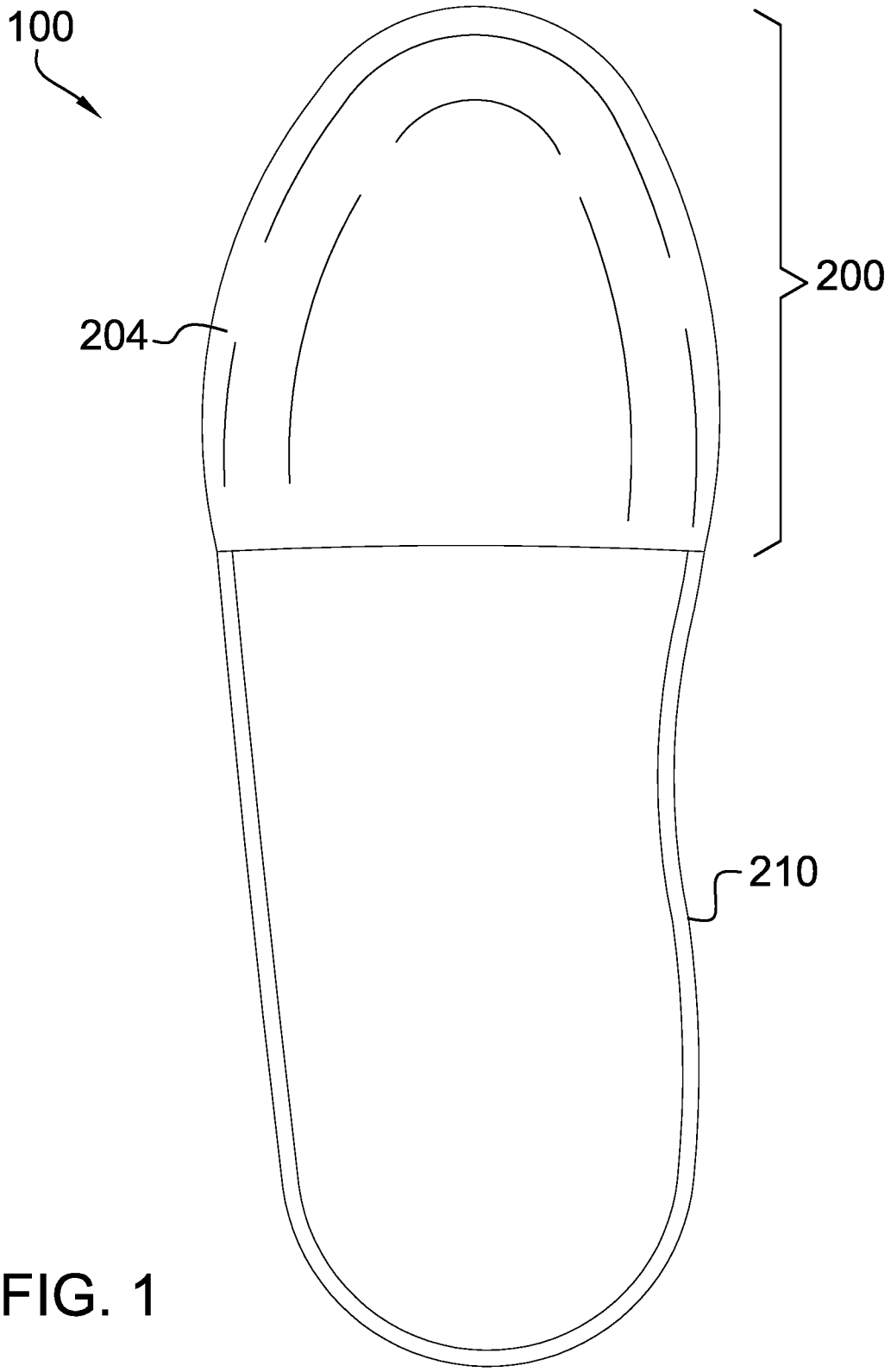
FIG. 1 is a top view of an embodiment of the disclosure.
Figure 2:
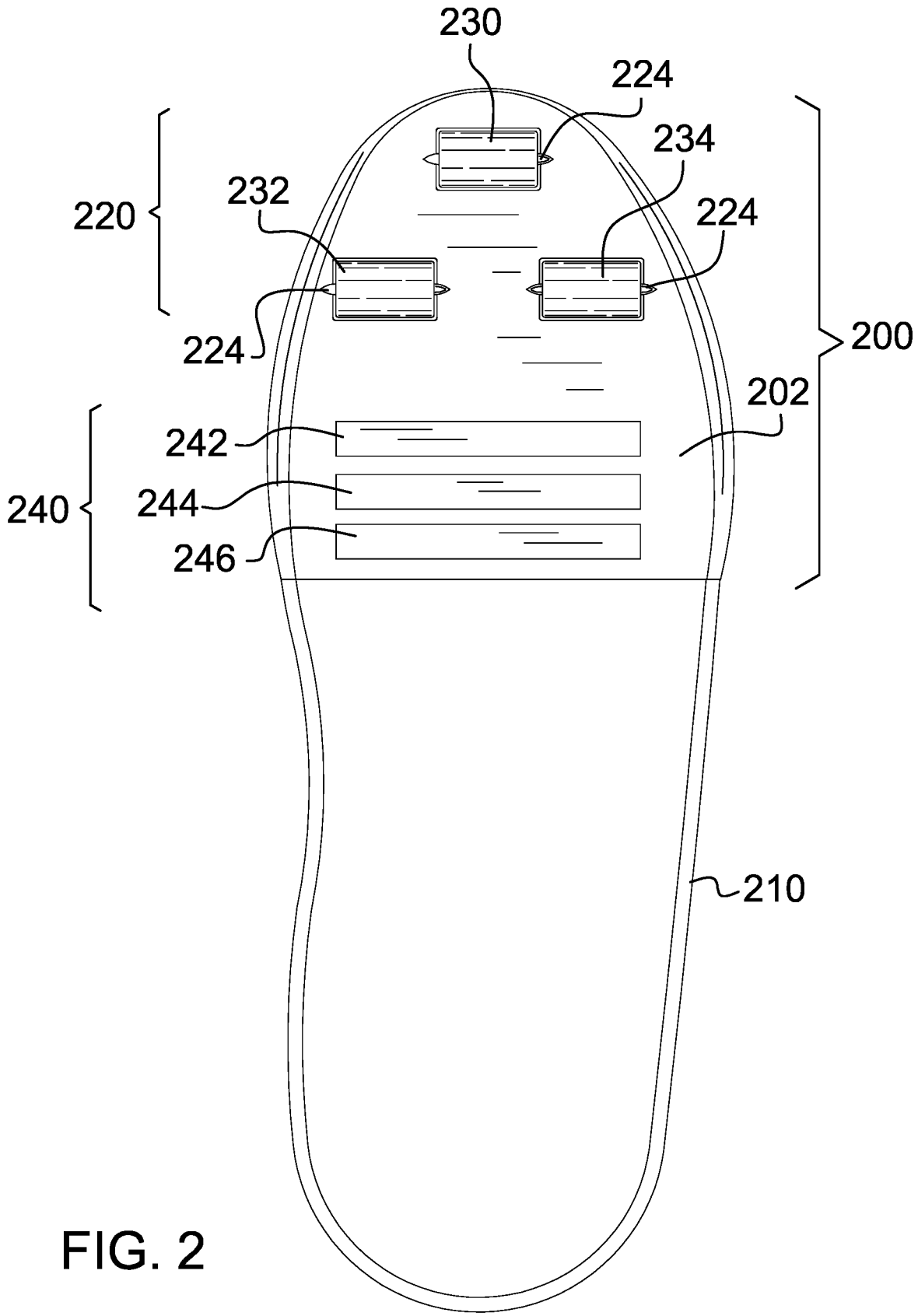
FIG. 2 is a bottom view of an embodiment of the disclosure.
Figure 3:
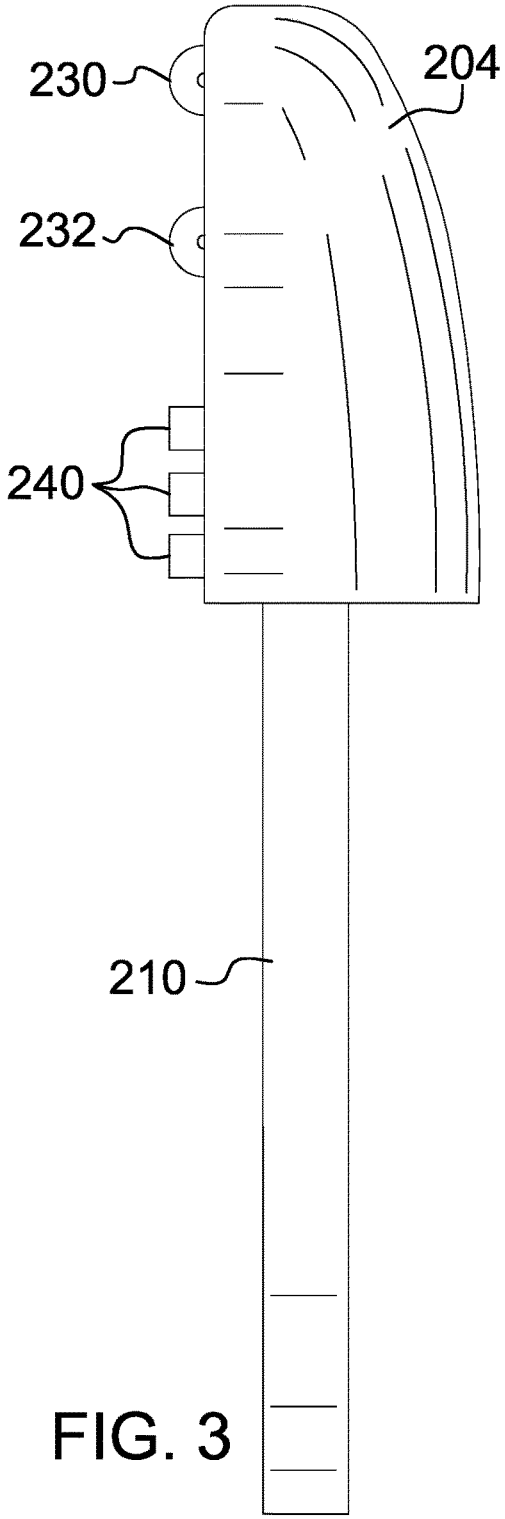
FIG. 3 is a left side view of an embodiment of the disclosure.
Figure 4:
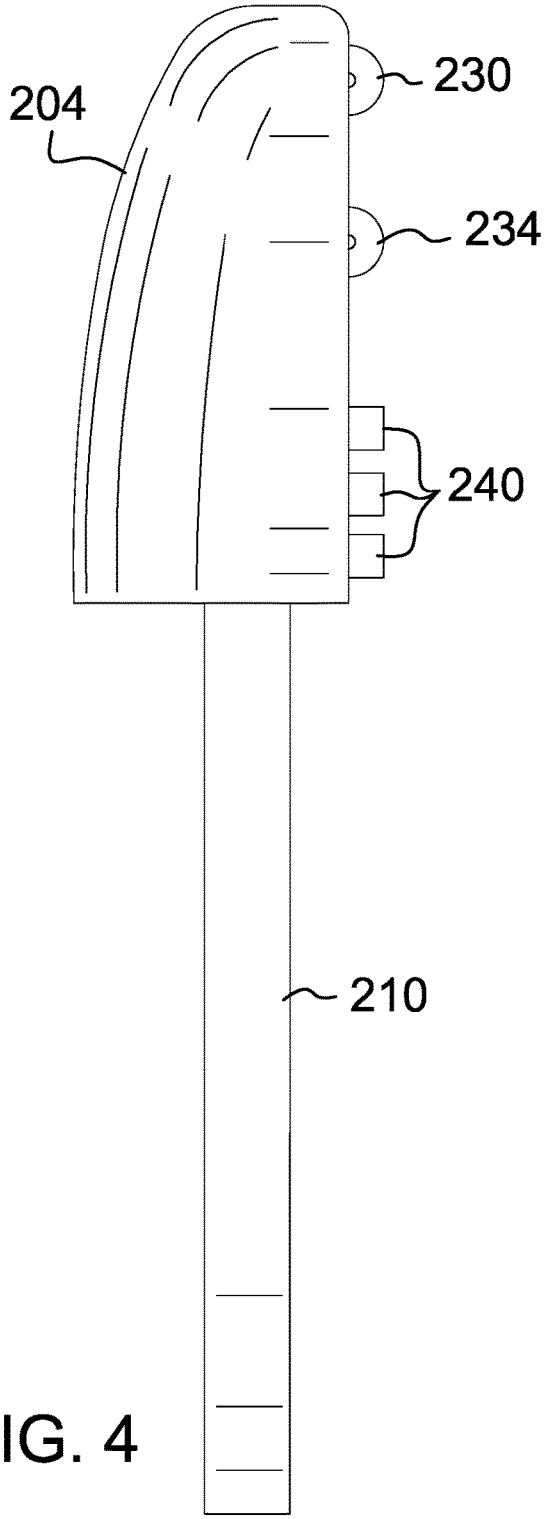
FIG. 4 is a right side view of an embodiment of the disclosure.
Figure 5:
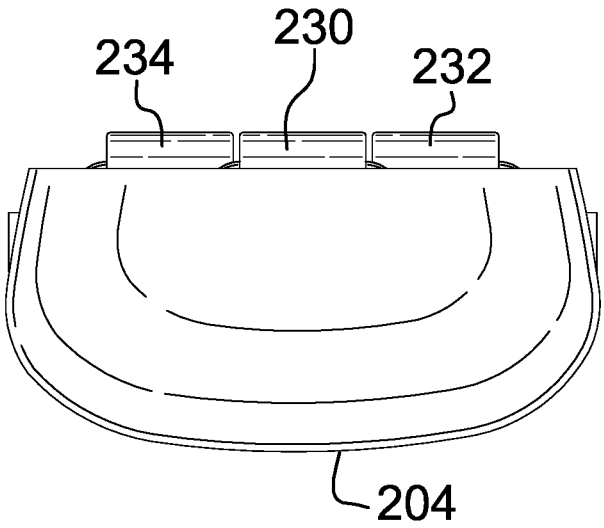
FIG. 5 is an inverted front view of an embodiment of the disclosure.
Figure 6:
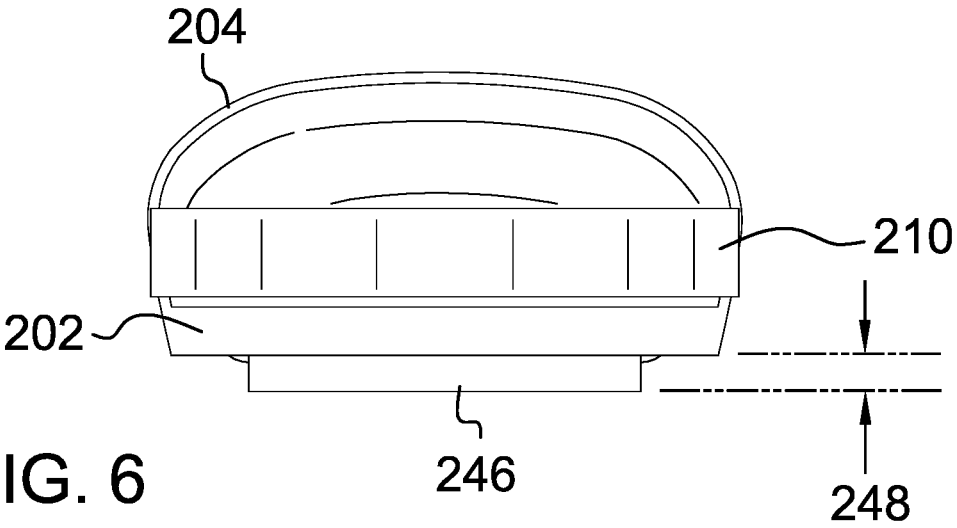
FIG. 6 is a rear view of an embodiment of the disclosure.
Figure 7:
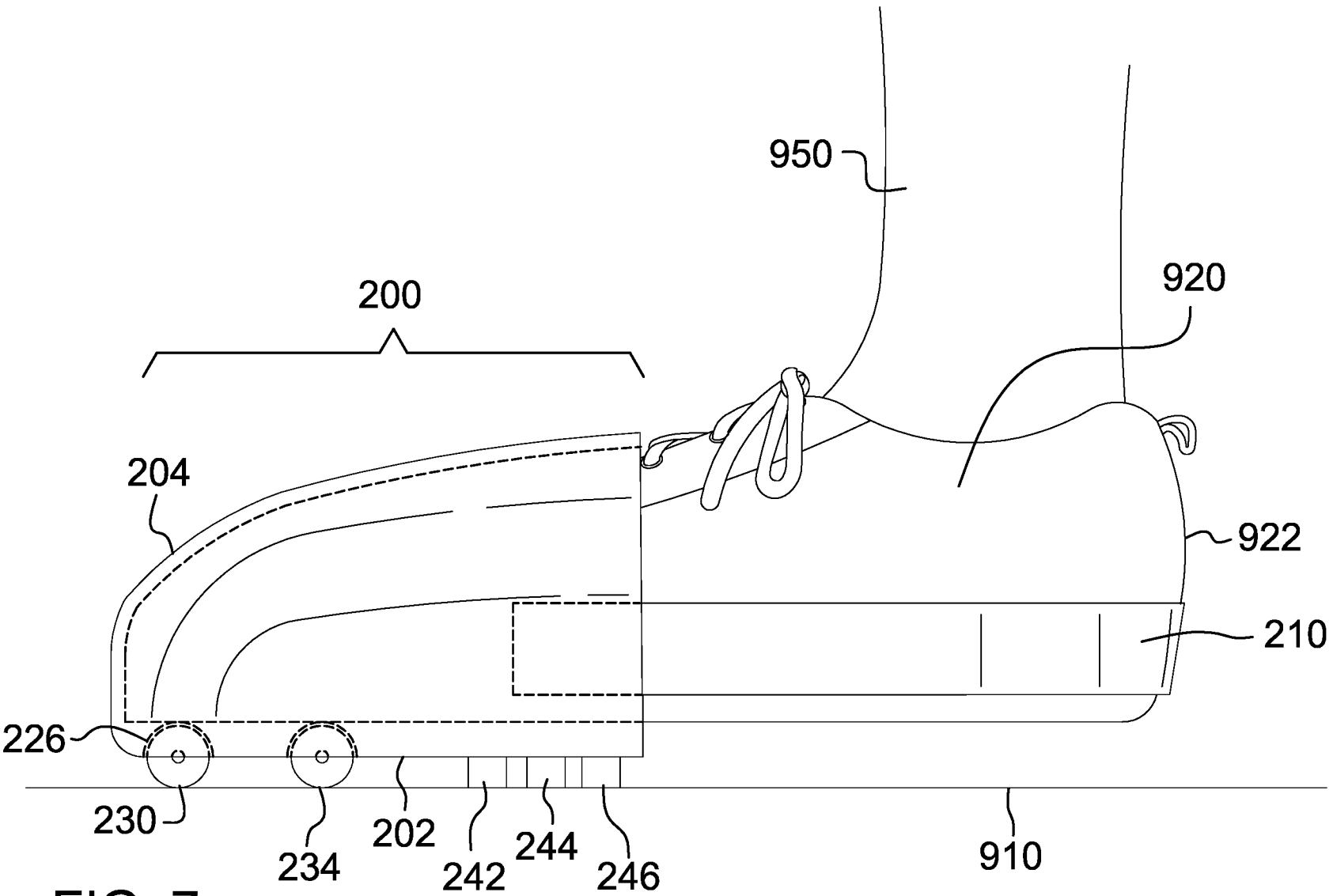
FIG. 7 is an in-use view of an embodiment of the disclosure.
Figure 8:
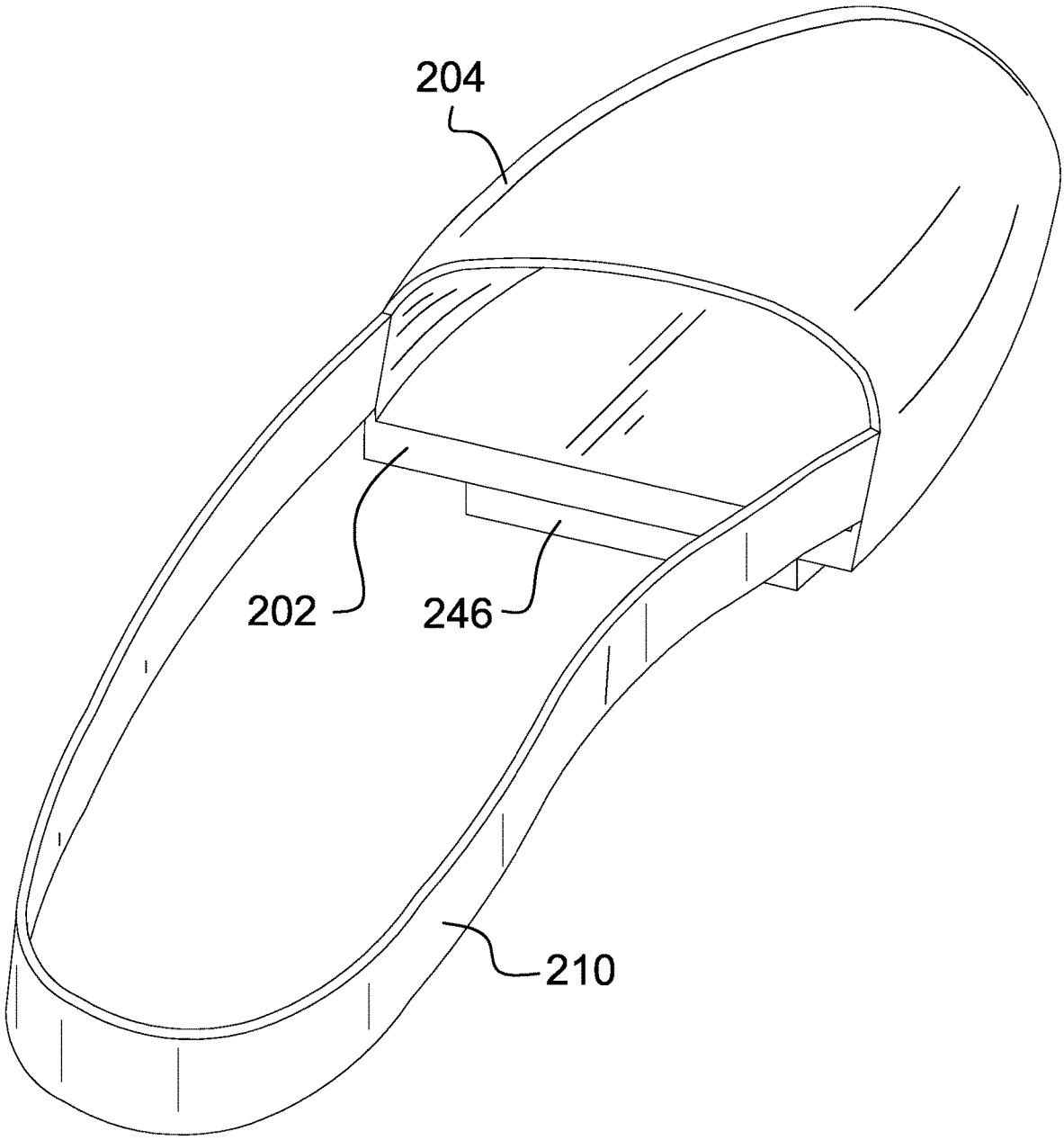
FIG. 8 is an isometric view of an embodiment of the disclosure.

Detailed reference will now be made to a first potential embodiment of the disclosure, which is illustrated in FIGS. 1 through 8.

The foot-attached exercise rollers 100 (hereinafter invention) comprises a toe cover 200, a strap 210, a plurality of rollers 220, and a plurality of grips 240. The invention 100 may be an exercise device that may be adapted to be worn on a foot 920. The toe cover 200 may cover the front of the foot 920 held in place by the strap 210. The plurality of rollers 220 may be adapted to reduce friction between the front of the toe cover 200 and a floor 910 and the plurality of grips 240 may be adapted to increase friction between the rear of the toe cover 200 and the floor 910. The invention 100 may be adapted to be worn in pairs to exercise the user's core as a user 950 moves the feet 920 back and forth on the plurality of rollers 220 while attempting to keeping the upper body still.

The toe cover 200 may be adapted for the user 950 to slide the front of a shoe into the toe cover 200. The toe cover 200 may comprise a sole 202 and a toe cap 204. The sole 202 may be the bottom layer of the toe cover 200. The toe cap 204 may couple to the sole 202 and may cover the front of the shoe. In some embodiments, the toe cover 200 may be made of a rigid, durable plastic.

The strap 210 may couple to the rear right and rear left of the toe cap 204. The strap 210 may be adapted to pass behind the user's ankle 922 to prevent the toe cover 200 from sliding forward. In some embodiments, the strap 210 may be made in part or in whole from nylon. In some embodiments, the strap 210 may be made in part or in whole from an elastic material.

The plurality of rollers 220 may reduce friction between the sole 202 of the toe cover 200 and the floor 910 when the user's weight is shifted forward over the plurality of rollers 220. rollers 220 may rotate around axles 224. The plurality of rollers 220 may be oriented laterally across the sole 202.

The plurality of rollers 220 may be inset into the bottom of the sole 202 such that the axles 224 extend into the sole 202 and the bottom of the plurality of rollers 220 is exposed beneath the sole 202. The top of the plurality of rollers 220 may be contained within cavities 226 in the sole 202 such that the plurality of rollers 220 do not extend into the interior of the toe cover 200.

The plurality of rollers 220 may be positioned to form a triangular pattern. A first roller 230 may be located at the front center of the sole 202. A second roller 232 and a third roller 234 may be located rearwards of the first roller 230 and laterally to each other.

The plurality of grips 240 may increase friction between the sole 202 of the toe cover 200 and the floor 910 when the user's weight is shifted rearwards over the plurality of grips 240. The plurality of grips 240 may be operable to prevent movement when the plurality of grips 240 are pressed against the floor 910.

In some embodiments, the plurality of grips 240 may be positioned to form three lateral rows. The plurality of grips 240 may be parallel to each other. The plurality of grips 240 may be adapted to vary the friction between the toe cover 200 and the floor 910 based upon the number of grips that are in contact with the floor 910. A first grip 242 may be frontmost. A second grip 244 may be at the center. A third grip 246 may be rearmost. In some embodiments, the first grip 242, the second grip 244, the third grip 246, or any combination thereof may comprise different materials and/or different grip heights 248 such that the friction between the toe cover 200 and the floor 910 may be determined by the distribution of the user's weight over the plurality of grips 240.

In use, the user 950 may don a pair of the toe covers 200 by sliding each of the toe covers 200 over the front of a foot 920 and placing the strap 210 behind the user's ankles 922. The user 950 may exercise by shifting the user's weight back and forth such that the user's weight is momentarily above the plurality of rollers 220 of one foot and then transfers to the plurality of rollers 220 of the opposite foot. The plurality of rollers 220 may reduce friction such that the foot 920 may be moved while supporting the user's weight. The plurality of grips 240 may be used to help stabilize the user 950 while exercising and/or to assist in recovering from a loss of balance.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "axle" may be a cylindrical shaft or rod that is inserted through the center of an object such that the center axis of the object and the center axis of the axle are aligned and the object can rotate using the axle as an axis of rotation.

As used herein, the words "couple", "couples", "coupled" or "coupling", may refer to connecting, either directly or indirectly, and does not necessarily imply a mechanical connection.

As used herein, the word "durable" may refer to a material's ability to withstand wear, pressure, impact, heat, cold, sun exposure, and other forms of potentially damaging conditions without suffering any significant deterioration of quality or value.

As used in this disclosure, "elastic" may refer to a material or object that deforms when a force is applied to stretch or compress the material and that returns to its relaxed shape after the force is removed. A material that exhibits these qualities is also referred to as an elastomeric material.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, the word "interior" may be used as a relational term that implies that an object is located or contained within the boundary of a structure or a space.

As used in this disclosure, the word "lateral" may refer to the sides of an object or movement towards a side. Lateral directions are generally perpendicular to longitudinal directions. "Laterally" may refer to movement in a lateral direction.

As used herein, "rigid" may refer to an object or material which is inflexible. A rigid object may break if force is applied to the object.

As used in this disclosure, the "sole" component of a shoe that forms the undersurface of the shoe and comes in contact with the ground.

With respect to the above description, it is to be realized that the optimum dimensional relationship for the various components of the invention described above and in FIGS. 1 through 8, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A foot-attached exercise rollers comprising:

a toe cover, a strap, a plurality of rollers, and a plurality of grips;

wherein the foot-attached exercise rollers is an exercise device that is adapted to be worn on a foot;

wherein the toe cover covers the front of the foot held in place by the strap;

wherein the plurality of rollers are adapted to reduce friction between the front of the toe cover and a floor and the plurality of grips are adapted to increase friction between the rear of the toe cover and the floor;

wherein the foot-attached exercise rollers are adapted to be worn in pairs to exercise the user's core as a user moves the feet back and forth on the plurality of rollers while attempting to keeping the upper body still;

wherein the plurality of grips is positioned to form three lateral rows;

wherein the plurality of grips is parallel to each other.

2. The foot-attached exercise rollers according to claim 1 wherein the toe cover is adapted for the user to slide the front of a shoe into the toe cover;

wherein the toe cover comprises a sole and a toe cap.

3. The foot-attached exercise rollers according to claim 2 wherein the sole is the bottom layer of the toe cover.

4. The foot-attached exercise rollers according to claim 3 wherein the toe cap couples to the sole and covers the front of the shoe.

5. The foot-attached exercise rollers according to claim 4 wherein the toe cover is made of a rigid, durable plastic.

6. The foot-attached exercise rollers according to claim 4 wherein the strap couples to the rear right and rear left of the toe cap;

wherein the strap is adapted to pass behind the user's ankle to prevent the toe cover from sliding forward.

7. The foot-attached exercise rollers according to claim 6 wherein the strap is made in part or in whole from nylon.

8. The foot-attached exercise rollers according to claim 6 wherein the strap is made in part or in whole from an elastic material.

9. The foot-attached exercise rollers according to claim 6 wherein the plurality of rollers reduce friction between the sole of the toe cover and the floor when the user's weight is shifted forward over the plurality of rollers.

10. The foot-attached exercise rollers according to claim 9 wherein the plurality of rollers are oriented laterally across the sole.

11. The foot-attached exercise rollers according to claim 9 wherein the plurality of rollers are inserted into the bottom of the sole such that the axles extend into the sole and the bottom of the plurality of rollers is exposed beneath the sole.

12. The foot-attached exercise rollers according to claim 11 wherein the top of the plurality of rollers are contained within cavities in the sole such that the plurality of rollers do not extend into an interior of the toe cover.

13. The foot-attached exercise rollers according to claim 12 wherein the plurality of rollers is positioned to form a triangular pattern.

14. The foot-attached exercise rollers according to claim 13 wherein a first roller is located at the front center of the sole;

wherein a second roller and a third roller are located rearwards of the first roller and laterally to each other.

15. The foot-attached exercise rollers according to claim 13 wherein the plurality of grips increase friction between the sole of the toe cover and the floor when the user's weight is shifted rearwards over the plurality of grips;

wherein the plurality of grips are operable to prevent movement when the plurality of grips are pressed against the floor.

16. The foot-attached exercise rollers according to claim 15 wherein the plurality of grips are adapted to vary the friction between the toe cover and the floor based upon the number of grips that are in contact with the floor.

17. The foot-attached exercise rollers according to claim 16 wherein a first grip of the plurality of grips is frontmost;

wherein a second grip of the plurality of grips is at the center;

wherein a third grip of the plurality of grips is rearmost.

* * * * *